US010593257B2

(12) United States Patent
Cook et al.

(10) Patent No.: US 10,593,257 B2
(45) Date of Patent: Mar. 17, 2020

(54) STRESS PROFILE COMPRESSION

(71) Applicant: Samsung Display Co., Ltd., Yongin-si, Gyeonggi-do (KR)

(72) Inventors: Gregory W. Cook, San Jose, CA (US); Amin Mobasher, San Jose, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/979,279

(22) Filed: May 14, 2018

(65) Prior Publication Data

US 2019/0287454 A1 Sep. 19, 2019

Related U.S. Application Data

(60) Provisional application No. 62/643,622, filed on Mar. 15, 2018.

(51) Int. Cl.
*G09G 3/3208* (2016.01)
*G09G 3/3225* (2016.01)

(52) U.S. Cl.
CPC ..... *G09G 3/3208* (2013.01); *G09G 3/3225* (2013.01); *G09G 2320/043* (2013.01); *G09G 2320/048* (2013.01); *G09G 2340/02* (2013.01); *G09G 2360/16* (2013.01)

(58) Field of Classification Search
CPC ..... G09G 3/3208; G09G 2320/043; G09G 2320/048
USPC ..... 345/214
See application file for complete search history.

(56) References Cited

U.S. PATENT DOCUMENTS

| | | | |
|---|---|---|---|
| 5,742,892 | A | 4/1998 | Chaddha |
| 6,195,128 | B1 | 2/2001 | Streater |
| 7,590,299 | B2 | 9/2009 | Brown et al. |
| 7,911,487 | B2 | 3/2011 | Brown et al. |
| 8,022,908 | B2 | 9/2011 | Mizukoshi et al. |
| 8,576,907 | B2 | 11/2013 | Demos et al. |
| 8,670,625 | B2 | 3/2014 | Sasai et al. |
| 8,879,857 | B2 | 11/2014 | Raveendran et al. |
| 9,392,292 | B2 | 7/2016 | Ku et al. |
| 9,351,003 | B2 | 10/2016 | Cote et al. |
| 9,799,257 | B2 | 10/2017 | Tian et al. |
| 2007/0229480 | A1 | 10/2007 | Ookawara |
| 2012/0327139 | A1 | 12/2012 | Margulis |

(Continued)

OTHER PUBLICATIONS

Sullivan, Gary, J., et al., "Overview of the High Efficiency Video Coding (HEVC) Standard", IEEE Transactions on Circuits and Systems for Video Technology, vol. 22, No. 12, Dec. 2012, pp. 1649-1668.

(Continued)

*Primary Examiner* — Michael Pervan
(74) *Attorney, Agent, or Firm* — Lewis Roca Rothgerber Christie LLP

(57) ABSTRACT

A system and method for operating a display. In some embodiments, the method includes: retrieving from a memory a first encoded stress profile and a first set of symbol statistics; processing, by a first decoder, the first encoded stress profile with the first set of symbol statistics, to form: a first decoded stress profile, and a second set of symbol statistics; augmenting the first decoded stress profile to form a second stress profile; processing, by an encoder, the second stress profile with the second set of symbol statistics to form a second encoded stress profile; and saving, in the memory, the second encoded stress profile.

20 Claims, 5 Drawing Sheets

(56) References Cited

U.S. PATENT DOCUMENTS

| | | | |
|---|---|---|---|
| 2014/0098858 | A1 | 4/2014 | Demos et al. |
| 2015/0194096 | A1 | 7/2015 | Chung et al. |
| 2017/0347098 | A1 | 11/2017 | Gilmutdinov et al. |

OTHER PUBLICATIONS

EPO Extended Search Report dated, Apr. 15, 2019, for corresponding European Patent Application No. 19161985.7 (9 pages).

STRESS PROFILE COMPRESSION

CROSS-REFERENCE TO RELATED APPLICATION(S)

The present application claims priority to and the benefit of U.S. Provisional Application No. 62/643,622, filed Mar. 15, 2018, entitled "STRESS PROFILE COMPRESSION", the entire content of which is incorporated herein by reference.

FIELD

One or more aspects of embodiments according to the present disclosure relate to stress compensation in a display, and more particularly to a system and method for compressed storage of stress profiles.

BACKGROUND

Compensation for output decline in a video display such as an organic light-emitting diode (OLED) display may be used to preserve image quality as a display ages. The data used to perform such compensation may be voluminous, however, potentially increasing the cost and power consumption of a display.

Thus, there is a need for an improved system and method for stress compensation.

SUMMARY

According to an embodiment of the present disclosure there is provided a method for operating a display, the method including: retrieving from a memory a first encoded stress profile and a first set of symbol statistics; processing, by a first decoder, the first encoded stress profile with the first set of symbol statistics, to form: a first decoded stress profile, and a second set of symbol statistics; augmenting the first decoded stress profile to form a second stress profile; processing, by an encoder, the second stress profile with the second set of symbol statistics to form a second encoded stress profile; and saving, in the memory, the second encoded stress profile.

In one embodiment, the processing, by the encoder, of the second stress profile with the second set of symbol statistics to form the second encoded stress profile includes encoding the second stress profile utilizing entropy encoding.

In one embodiment, the processing, by the encoder, of the second stress profile with the second set of symbol statistics to form the second encoded stress profile includes encoding the second stress profile utilizing arithmetic encoding.

In one embodiment, the method includes: processing, by a second decoder, the first encoded stress profile with the first set of symbol statistics, to form the first decoded stress profile; calculating a first adjusted drive current, based on a first raw drive current and on the first decoded stress profile; and driving a sub-pixel of the display with a current equal to the first adjusted drive current.

In one embodiment, the augmenting of the first decoded stress profile to form the second stress profile includes adding to an element of the first decoded stress profile a number proportional to the first adjusted drive current.

In one embodiment, the method includes: after driving the sub-pixel of the display with the current equal to the first adjusted drive current: calculating a second adjusted drive current, based on a second raw drive current and on the first decoded stress profile; and driving the sub-pixel of the display with a current equal to the second adjusted drive current.

In one embodiment, the augmenting of the first decoded stress profile to form the second stress profile includes adding to an element of the first decoded stress profile a number proportional to the second adjusted drive current.

According to an embodiment of the present disclosure there is provided a system for performing stress compensation in a display, the system including: a memory; and a processing circuit including a first decoder and an encoder, the processing circuit being configured to: retrieve from a memory a first encoded stress profile and a first set of symbol statistics; process, by the first decoder, the first encoded stress profile with the first set of symbol statistics, to form: a first decoded stress profile, and a second set of symbol statistics; augment the first decoded stress profile to form a second stress profile; process, by the encoder, the second stress profile with the second set of symbol statistics to form a second encoded stress profile; and save, in the memory, the second encoded stress profile.

In one embodiment, the processing, by the encoder, of the second stress profile with the second set of symbol statistics to form the second encoded stress profile includes encoding the second stress profile utilizing entropy encoding.

In one embodiment, the processing, by the encoder, of the second stress profile with the second set of symbol statistics to form the second encoded stress profile includes encoding the second stress profile utilizing arithmetic encoding.

In one embodiment, the processing circuit further includes a second decoder and the processing circuit is further configured to: process, by the second decoder, the first encoded stress profile with the first set of symbol statistics, to form the first decoded stress profile; calculate a first adjusted drive current, based on a first raw drive current and on the first decoded stress profile; and drive a sub-pixel of the display with a current equal to the first adjusted drive current.

In one embodiment, the augmenting of the first decoded stress profile to form the second stress profile includes adding to an element of the first decoded stress profile a number proportional to the first adjusted drive current.

In one embodiment, the processing circuit is further configured to: after driving the sub-pixel of the display with the current equal to the first adjusted drive current: calculate a second adjusted drive current, based on a second raw drive current and on the first decoded stress profile; and drive the sub-pixel of the display with a current equal to the second adjusted drive current.

In one embodiment, the augmenting of the first decoded stress profile to form the second stress profile includes adding to an element of the first decoded stress profile a number proportional to the second adjusted drive current.

According to an embodiment of the present disclosure there is provided a display, including: a display panel; a memory; and a processing circuit including a first decoder and an encoder, the processing circuit being configured to: retrieve from a memory a first encoded stress profile and a first set of symbol statistics; process, by the first decoder, the first encoded stress profile with the first set of symbol statistics, to form: a first decoded stress profile, and a second set of symbol statistics; augment the first decoded stress profile to form a second stress profile; process, by the encoder, the second stress profile with the second set of symbol statistics to form a second encoded stress profile; and save, in the memory, the second encoded stress profile.

In one embodiment, the processing, by the encoder, of the second stress profile with the second set of symbol statistics to form the second encoded stress profile includes encoding the second stress profile utilizing entropy encoding.

In one embodiment, the processing, by the encoder, of the second stress profile with the second set of symbol statistics to form the second encoded stress profile includes encoding the second stress profile utilizing arithmetic encoding.

In one embodiment, the processing circuit further includes a second decoder and the processing circuit is further configured to: process, by the second decoder, the first encoded stress profile with the first set of symbol statistics, to form the first decoded stress profile; calculate a first adjusted drive current, based on a first raw drive current and on the first decoded stress profile; and drive a sub-pixel of the display with a current equal to the first adjusted drive current.

In one embodiment, the processing circuit is further configured to: after driving the sub-pixel of the display with the current equal to the first adjusted drive current: calculate a second adjusted drive current, based on a second raw drive current and on the first decoded stress profile; and drive the sub-pixel of the display with a current equal to the second adjusted drive current.

In one embodiment, the augmenting of the first decoded stress profile to form the second stress profile includes adding to an element of the first decoded stress profile a number proportional to the second adjusted drive current.

BRIEF DESCRIPTION OF THE DRAWINGS

These and other features and advantages of the present disclosure will be appreciated and understood with reference to the specification, claims, and appended drawings wherein:

DETAILED DESCRIPTION

The detailed description set forth below in connection with the appended drawings is intended as a description of exemplary embodiments of a system and method for stress profile compression provided in accordance with the present disclosure and is not intended to represent the only forms in which the present disclosure may be constructed or utilized. The description sets forth the features of the present disclosure in connection with the illustrated embodiments. It is to be understood, however, that the same or equivalent functions and structures may be accomplished by different embodiments that are also intended to be encompassed within the scope of the disclosure. As denoted elsewhere herein, like element numbers are intended to indicate like elements or features.

Certain kinds of video displays may have characteristics that change with use. For example, an organic light-emitting diode (OLED) display may include a display panel having a plurality of pixels, each consisting of several subpixels (e.g., a red subpixel, a green subpixel, and a blue subpixel), and each of the subpixels may include an organic light-emitting diode configured to emit a different respective color. Each organic light-emitting diode may have an optical efficiency that declines with use, so that, for example, after the organic light-emitting diode has been in operation for some time, the optical output at a certain current may be lower than it was, at the same current, when the organic light-emitting diode was new.

This reduction in optical efficiency may result in dimming of parts of a display panel that have on average, during the life of the display, displayed brighter portions of the displayed images than other parts of the display. For example, a display used to view largely unchanging images from a security camera, the field of view of which contains a scene having a first portion which is sunlit, and relatively bright, during most of the day, and a second portion which is in the shade and relatively dim, during most of the day, may eventually show a more significant decrease in optical efficiency in the first portion than in the second portion. The fidelity of image reproduction of such a display may degrade over time as a result. As another example, a display that is used part of the time to display white text at the bottom of the image, separated by a black margin from the rest of the image, may experience a lower reduction of optical efficiency in the black margin than in other parts of the display panel, so that if the display is later used in a mode in which a scene fills the entire display panel, a brighter band may appear where the black margin was previously displayed (image sticking).

Figure 1:
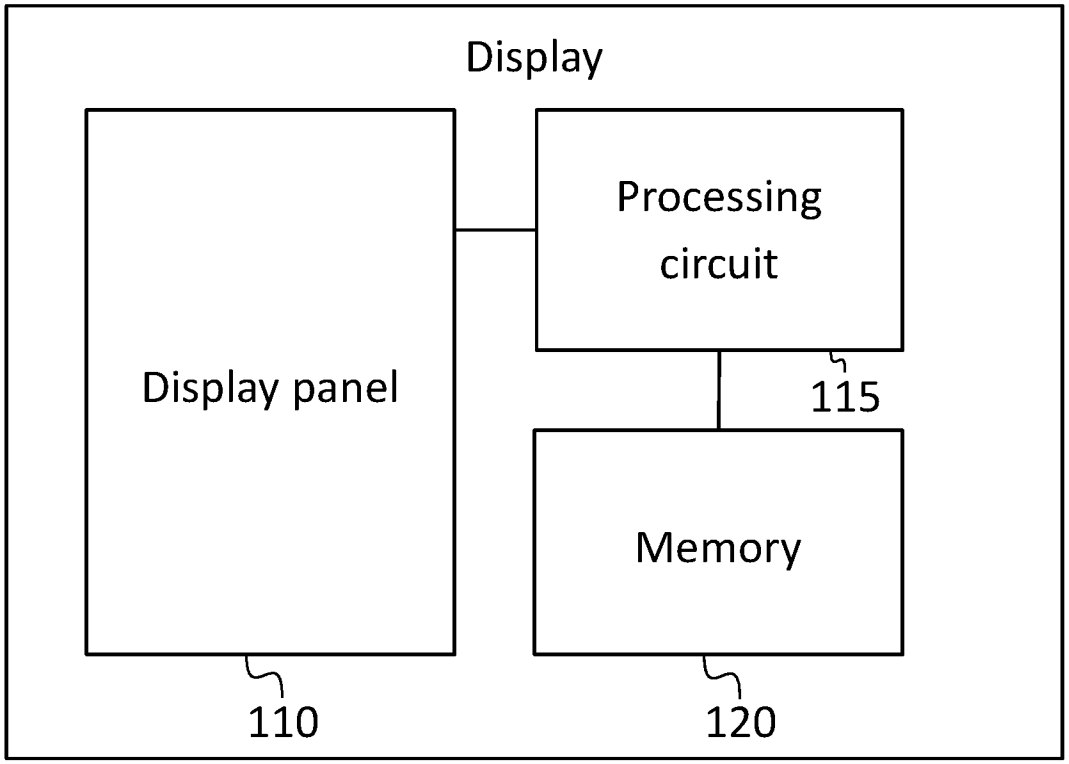
FIG. 1 is a block diagram of a display, according to an embodiment of the present disclosure.

To reduce the effect of such non-uniformities in the optical efficiency of a display, a display may include features to compensate for the reduction of optical efficiency resulting from use of the display. Referring to FIG. 1, such a display may include the display panel 110, a processing circuit 115 (discussed in further detail below), and a memory 120. The contents of the memory, which may be referred to as a "stress profile" or "stress table" for the display, may be a table of numbers (or "stress values") indicating (or from which may be inferred) the amount of stress each sub-pixel has been subjected to during the life of the display. The "stress" may be the total (time-integrated) drive current that has flowed through the sub-pixel during the life of the display, i.e., the total charge that has flowed through the sub-pixel during the life of the display. For example, the memory may accumulate one number for each sub-pixel; each time a new image is displayed, e.g., as part of a continuous stream of images together forming displayed video (or less frequently, as described below, to reduce the burden on the stress compensation system), the drive current for each sub-pixel in the image may be measured and a number indicating the current or brightness of the subpixel may be added to the respective number for that sub-pixel in the memory. In a display having a timing controller and a plurality of driver integrated circuits, the processing circuit may be, or may be part of, one or more of the driver integrated circuits. In some embodiments, each driver integrated circuit is responsible for driving a portion of the display panel, and it may accordingly perform stress tracking and stress compensation for that portion, independently of the other driver integrated circuits.

During operation, the drive current to each sub-pixel may be adjusted to compensate for an estimated loss of optical efficiency, the estimated loss of optical efficiency being based on the lifetime stress of the sub-pixel. For example the drive current to each sub-pixel may be increased in accordance with (e.g., in proportion to) the estimated loss of optical efficiency of the sub-pixel accumulated in the memory, so that the optical output may be substantially the same as it would have been had the optical efficiency of the sub-pixel not been reduced, and had the drive current not been increased. A non-linear function based on empirical data or a model of the physics of the sub-pixel may be used to infer or predict the loss of optical efficiency expected to be present, based on the lifetime stress of the sub-pixel. The calculations of the predicted loss of optical efficiency, and of the accordingly adjusted drive current, may be performed by the processing circuit.

Figure 2:
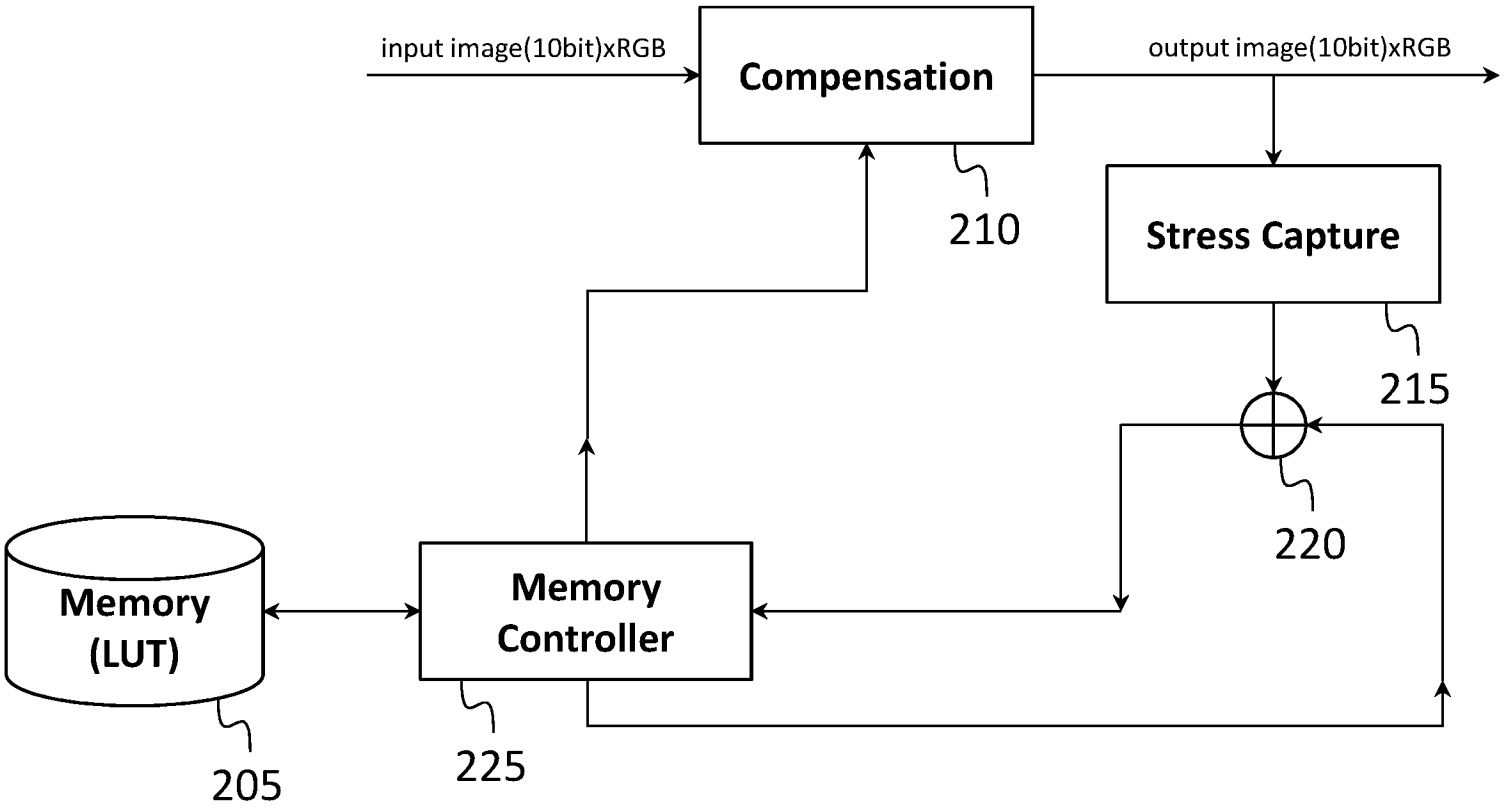
FIG. 2 is a block diagram of a system for stress compensation without compression, according to an embodiment of the present disclosure.

FIG. 2 shows a block diagram of a system for stress compensation. The stress table is stored in the memory 205. In operation, stress values are read out of the stress table and used by a drive current adjustment circuit 210 ("Compensation Block"), to calculate adjusted drive current values, each adjusted drive current value being a raw drive current value (based on the desired optical output of the sub-pixel), adjusted according to the accumulated stress of the sub-pixel. The adjusted drive current values (which represent the current rate of accumulation of stress of the sub-pixels being displayed) are read by a sub-pixel stress sampling circuit 215 ("Stress Capture Block") and each previously stored stress value is increased (or "augmented"), in an adding circuit 220, by the current rate of accumulation of stress (i.e., by a number proportional to the adjusted drive current value), and saved back to the memory 205. A memory controller 225 controls read and write operations in the memory, feeds the stress values from the memory to the drive current adjustment circuit 210 and to the adding circuit 220 as needed, and stores the augmented stress values (having been augmented by the addition of the current rate of accumulation of stress) back into memory.

Tracking the total stress of each sub-pixel may require a significant amount of memory. For example, for a display with 1920×1080 pixels, with three sub-pixels per pixel, and with the stress of each sub-pixel stored as a 4-byte (32-bit) number, the size of the memory required may be approximately 25 megabytes. Moreover, the computational burden of updating each stress number for each frame of video (i.e., for each displayed image) may be significant.

Various approaches may be used to reduce the burden of tracking, and correcting for the reduction in optical efficiency resulting from, sub-pixel stress. For example, the sub-pixel stress sampling circuit 215 may sample only a subset of the adjusted drive current values in each image (i.e., in each frame of video). For example, in a display having 1080 lines (or rows) of pixels, in some embodiments only one row of the stress table is updated per frame of video. The discarding of the intervening 1079 adjusted drive current values, between pairs of adjusted drive current values that are taken into account, for any sub-pixel may result in only a small, acceptable loss of accuracy in the resulting stress values (as a measure of the lifetime stress of the sub-pixel) if, for example, the scene changes relatively slowly in the video being displayed.

In another embodiment, the sub-pixel stress sampling circuit 215 may in addition sample only at subset of frames. For example, in a display having 1080 lines (or rows) with a refresh rate of 60 Hz (showing 60 frames per minute), the stress sampling circuit 215 samples all or partial drive current values in the image once every 10 frames and the stress table is updated accordingly.

Figure 3:
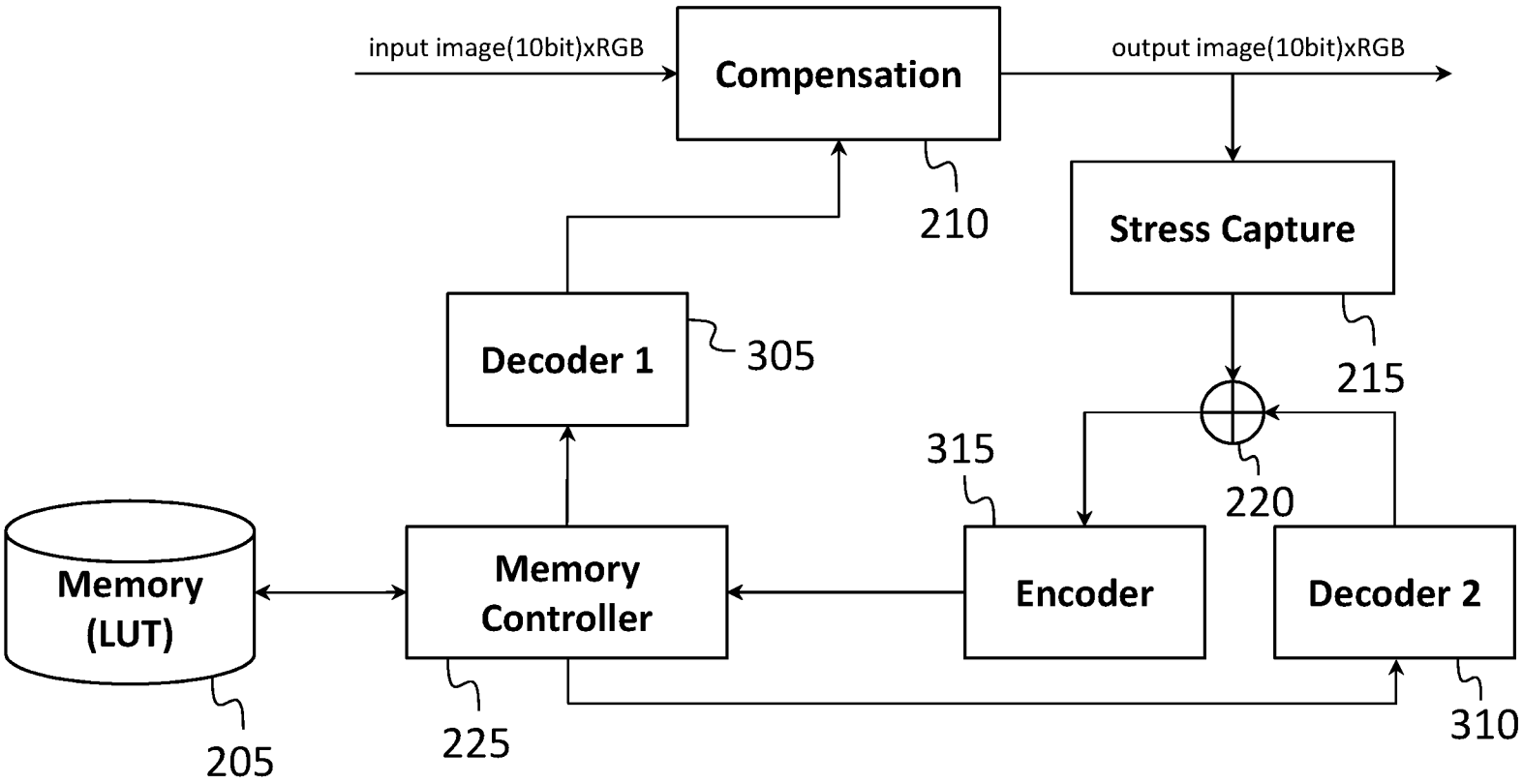
FIG. 3 is a block diagram of a system for stress compensation with compression, according to an embodiment of the present disclosure.

Various approaches may also be used to reduce the memory size required for storing sub-pixel stress in the stress table. For example the memory on the stress profile chipset may be reduced by compressing the data stored in the memory. Referring to FIG. 3, in some embodiments, a compressed representation of the stress table is stored in the memory 205; the compressed stress data are decompressed by a first decoder 305 before being fed to the drive current adjustment circuit 210. The compressed stress data are decompressed by a second decoder 310 before being sent to the adding circuit 220, and the augmented stress values are encoded, or compressed, by an encoder 315, before being stored in the memory 205. The encoder 315 encodes data that it receives in a manner that compresses it, and each of the first decoder 305 and the second decoder 310 performs an operation that inverts, or approximately inverts, the operation performed by the encoder 315, i.e., each of the first decoder 305 and the second decoder 310 decompresses data that it receives. Accordingly, "coding" and "compressing" (and related words, such as "encoding" and "encoded", and "compressed", respectively) are used interchangeably herein, as are "decoding" and "decompressing" (and related words, such as "decoded" and "unencoded", and "decompressed" and "uncompressed", respectively). Various methods of compression may be employed, including entropy coding, such as Huffman coding or arithmetic coding.

Figure 4:
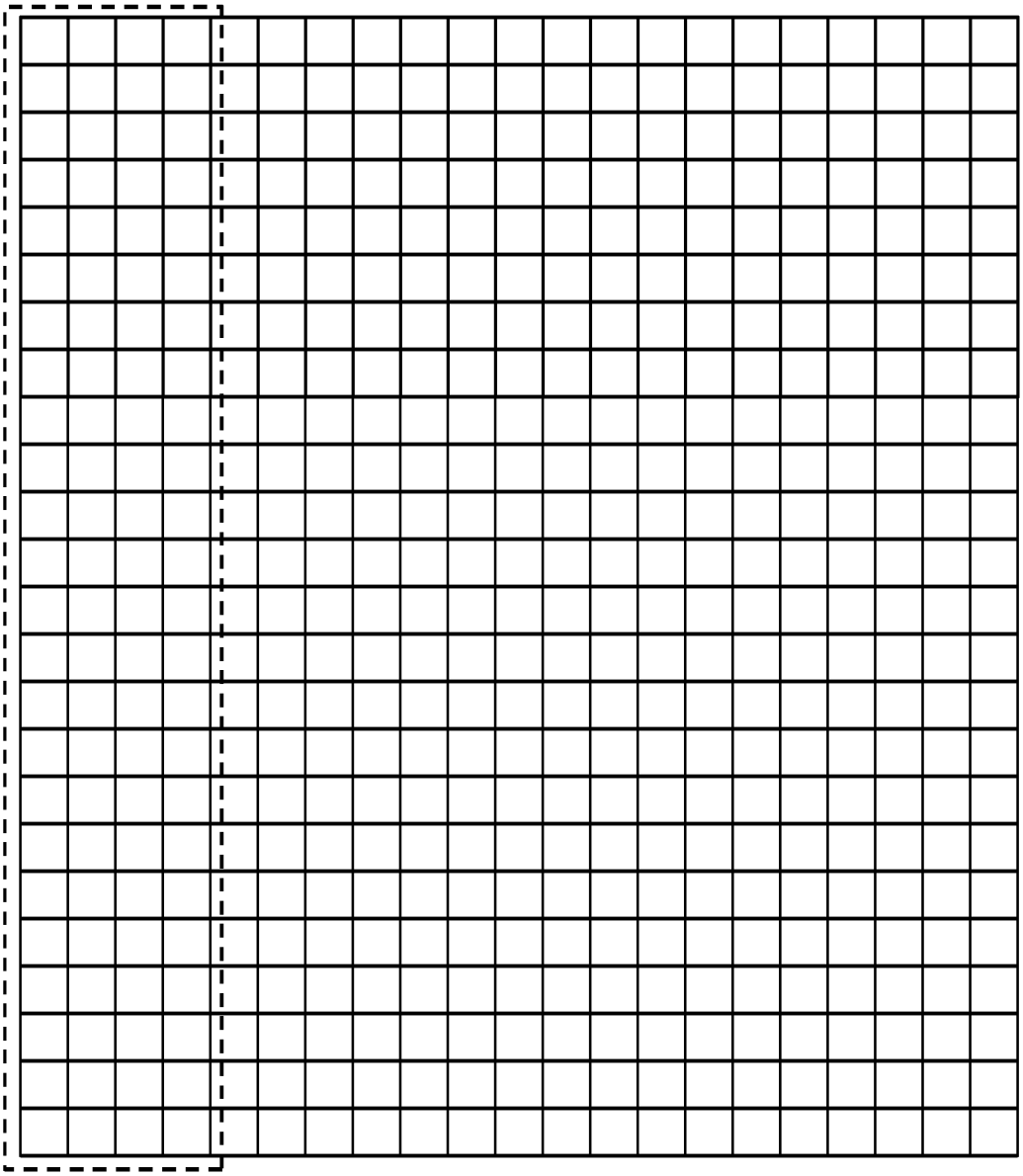
FIG. 4 is a schematic drawing of a portion of a display, according to an embodiment of the present disclosure.

Stress table data may be encoded and decoded in blocks referred to herein as "slices", each of which may in general be in arbitrary subset of the stress table. In some embodiments each slice corresponds to a square or rectangular region of the stress table, and to a square or rectangular region of the display panel. The square or rectangular region of the display panel may be referred to as a slice of the display, and the corresponding slice of the stress table data may be referred to as the stress profile of the slice of the display. Unless otherwise specified, a "slice", as used herein, refers to a slice of the stress profile. The horizontal dimension of the region of the display panel to which a slice corresponds may be referred to as the "slice width" and the vertical dimension may be referred to as the "line dimension" or "slice height". For example, as illustrated in FIG. 4, a slice may correspond to 4 lines and 24 columns of the display, i.e., it may have a slice width of 24 and a line dimension of 4.

The size of the region of memory allocated to storing the compressed representation of each slice may be fixed or variable based on the compression algorithm used. In one embodiment, it can be fixed and selected based on an estimated compression ratio for the coding method used. The compression ratio achieved in operation may vary, however, depending on, for example, the extent to which symbols are repeated in the uncompressed data. When the compression ratio achieved in operation is not sufficiently high to allow the compressed slice to fit within the region of memory allocated to storing the compressed representation of the slice, the raw data may be truncated (i.e., one or more of the least-significant bits of each data word may be removed) before compression is performed, to reduce the size, in memory, of the compressed representation of the slice, so that it will fit within the region of memory allocated to storing the compressed representation of the slice. In another embodiment, the required memory length can be calculated to cover the worst case scenario. In another embodiment, the length of compressed representation can be variable and it is stored in a table or it is appended to the compressed data.

Figure 5:
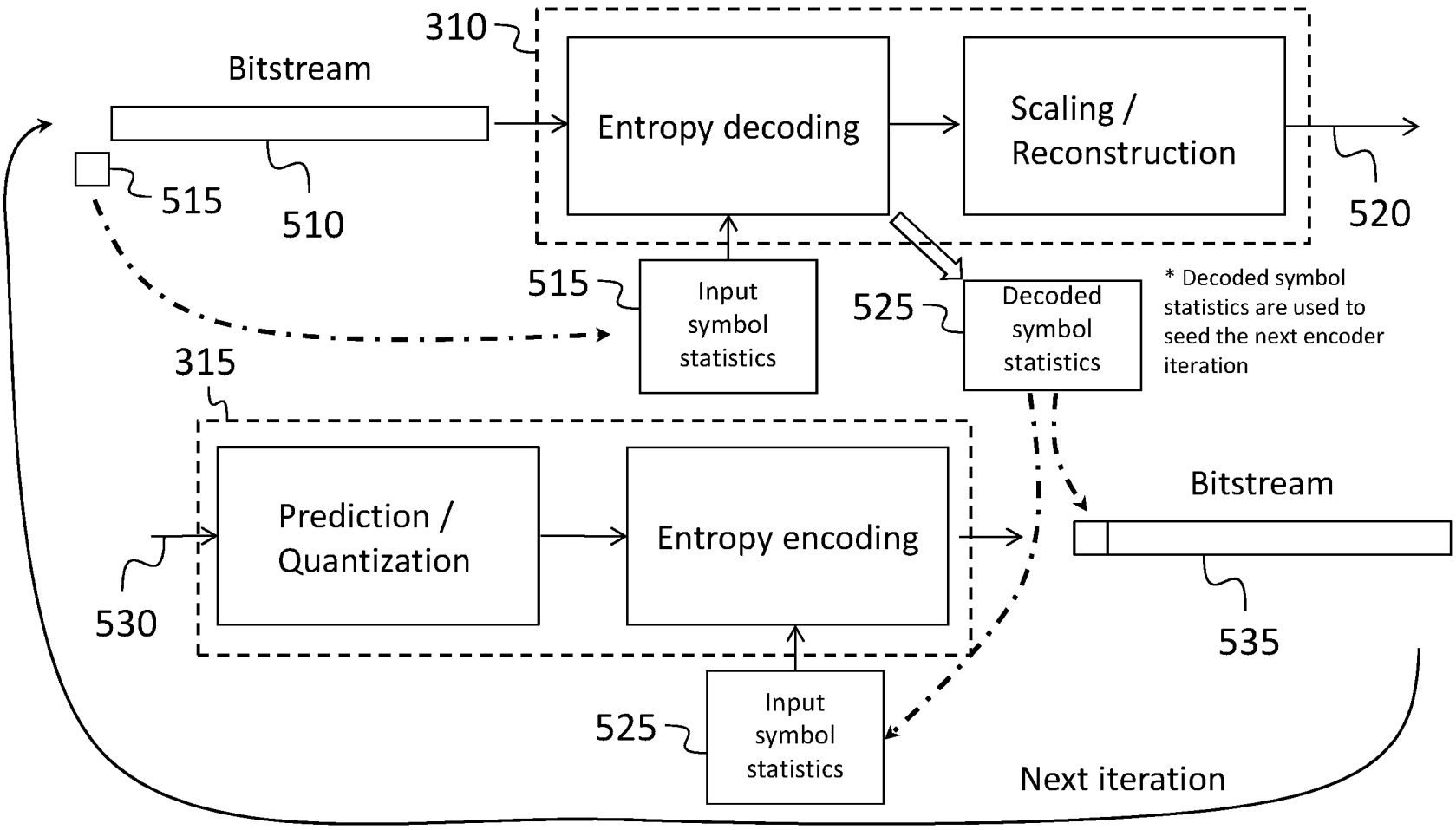
FIG. 5 is a block diagram of a system for stress compensation, according to an embodiment of the present disclosure.

Referring to FIG. 5, in some embodiments, as mentioned above, the encoding and decoding may be performed utilizing entropy encoding; the coding used may be adaptive, and the statistics used to encode the uncompressed slices and to decode the compressed slices may accordingly be updated periodically. In some embodiments, because the encoder 315 and the second decoder 310 are collocated, these two circuits may share statistics, and, for example, decoded symbol statistics 525 generated by the second decoder 310 may be used to seed the encoder 315. In operation, a first encoded stress profile and a first set of symbol statistics may be retrieved from memory, and the first encoded stress profile may be used as the input bit stream 510 to the second decoder 310. The first set of symbol statistics may be used as the decoding symbol statistics 515 fed to the second decoder 310.

The second decoder 310 may process the first encoded stress profile with the first set of symbol statistics to form (i) a first decoded stress profile (at the output 520 of the second decoder 310), and (ii) a second (updated) set of symbol statistics 525, which may be stored in a local memory or set of registers shared with the encoder 315. After the first decoded stress profile is augmented in the adding circuit 220 (FIG. 3), forming a second stress profile, the second stress profile is fed into the input 530 of the encoder 315, and is encoded using the second set of symbol statistics 525 generated by the second decoder 310 and shared with the encoder 315. The resulting second encoded stress profile 535 is then fed out of the encoder 315, and sent to the memory controller 225 to be saved in the memory 205. This process may be repeated each time the slice is updated.

In some embodiments, the encoder includes, in addition to an entropy encoding circuit, a prediction and quantization circuit as shown, which may use, for example, the augmented stress value of a preceding sub-pixel in the slice as a prediction of the augmented stress value of the sub-pixel to be encoded, and, instead of directly encoding the augmented stress value of the sub-pixel to be encoded, the encoder 315 may encode the difference (i.e., the difference between the augmented stress value of the sub-pixel to be encoded, and the predicted value of the augmented stress value of the sub-pixel to be encoded). The quantization circuit may perform truncation, as described above.

Although the embodiments described in detail herein relate to a system and method for stress profile compression, the disclosure is not limited thereto, and an analogous system and method may be used in any application in which the encoder and decoder are collocated.

The term "processing circuit" is used herein to mean any combination of hardware, firmware, and software, employed to process data or digital signals. Processing circuit hardware may include, for example, application specific integrated circuits (ASICs), general purpose or special purpose central processing units (CPUs), digital signal processors (DSPs), graphics processing units (GPUs), and programmable logic devices such as field programmable gate arrays (FPGAs). In a processing circuit, as used herein, each function is performed either by hardware configured, i.e., hard-wired, to perform that function, or by more general purpose hardware, such as a CPU, configured to execute instructions stored in a non-transitory storage medium. A processing circuit may be fabricated on a single printed circuit board (PCB) or distributed over several interconnected PCBs. A processing circuit may contain other processing circuits; for example a processing circuit may include two processing circuits, an FPGA and a CPU, interconnected on a PCB.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art. As used herein, the term "major component" refers to a component that is present in a composition, polymer, or product in an amount greater than an amount of any other single component in the composition or product. In contrast, the term "primary component" refers to a component that makes up at least 50% by weight or more of the composition, polymer, or product. As used herein, the term "major portion", when applied to a plurality of items, means at least half of the items.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present disclosure". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

Although exemplary embodiments of a system and method for stress profile compression have been specifically described and illustrated herein, many modifications and variations will be apparent to those skilled in the art. Accordingly, it is to be understood that a system and method for stress profile compression constructed according to principles of this disclosure may be embodied other than as specifically described herein. The invention is also defined in the following claims, and equivalents thereof.

What is claimed is:

1. A method for operating a display, the method comprising:

retrieving from a memory a first encoded stress profile and a first set of symbol statistics;

processing, by a first decoder, the first encoded stress profile, using the first set of symbol statistics, to form:
a first decoded stress profile, and
a second set of symbol statistics;

augmenting the first decoded stress profile to form a second stress profile;

processing, by an encoder, the second stress profile, using the second set of symbol statistics to form a second encoded stress profile; and saving, in the memory, the second encoded stress profile.

2. The method of claim 1, wherein the processing, by the encoder, of the second stress profile with the second set of symbol statistics to form the second encoded stress profile comprises encoding the second stress profile utilizing entropy encoding.

3. The method of claim 2, wherein the processing, by the encoder, of the second stress profile with the second set of symbol statistics to form the second encoded stress profile comprises encoding the second stress profile utilizing arithmetic encoding.

4. The method of claim 1, further comprising:

processing, by a second decoder, the first encoded stress profile with the first set of symbol statistics, to form the first decoded stress profile;

calculating a first adjusted drive current, based on a first raw drive current and on the first decoded stress profile; and driving a sub-pixel of the display with a current equal to the first adjusted drive current.

5. The method of claim 4, wherein the augmenting of the first decoded stress profile to form the second stress profile comprises adding to an element of the first decoded stress profile a number proportional to the first adjusted drive current.

6. The method of claim 4, further comprising:

after driving the sub-pixel of the display with the current equal to the first adjusted drive current:

calculating a second adjusted drive current, based on a second raw drive current and on the first decoded stress profile; and driving the sub-pixel of the display with a current equal to the second adjusted drive current.

7. The method of claim 6, wherein the augmenting of the first decoded stress profile to form the second stress profile comprises adding to an element of the first decoded stress profile a number proportional to the second adjusted drive current.

8. A system for performing stress compensation in a display, the system comprising:

a memory; and a processing circuit comprising a first decoder and an encoder, the processing circuit being configured to:

retrieve from a memory a first encoded stress profile and a first set of symbol statistics;

process, by the first decoder, the first encoded stress profile, using the first set of symbol statistics, to form:
a first decoded stress profile, and
a second set of symbol statistics;

augment the first decoded stress profile to form a second stress profile;

process, by the encoder, the second stress profile, using the second set of symbol statistics to form a second encoded stress profile; and save, in the memory, the second encoded stress profile.

9. The system of claim 8, wherein the processing, by the encoder, of the second stress profile with the second set of symbol statistics to form the second encoded stress profile comprises encoding the second stress profile utilizing entropy encoding.

10. The system of claim 9, wherein the processing, by the encoder, of the second stress profile with the second set of symbol statistics to form the second encoded stress profile comprises encoding the second stress profile utilizing arithmetic encoding.

11. The system of claim 8, wherein the processing circuit further comprises a second decoder and the processing circuit is further configured to:

process, by the second decoder, the first encoded stress profile with the first set of symbol statistics, to form the first decoded stress profile;

calculate a first adjusted drive current, based on a first raw drive current and on the first decoded stress profile; and drive a sub-pixel of the display with a current equal to the first adjusted drive current.

12. The system of claim 11, wherein the augmenting of the first decoded stress profile to form the second stress profile comprises adding to an element of the first decoded stress profile a number proportional to the first adjusted drive current.

13. The system of claim 11, wherein the processing circuit is further configured to:

after driving the sub-pixel of the display with the current equal to the first adjusted drive current:

calculate a second adjusted drive current, based on a second raw drive current and on the first decoded stress profile; and drive the sub-pixel of the display with a current equal to the second adjusted drive current.

14. The system of claim 13, wherein the augmenting of the first decoded stress profile to form the second stress profile comprises adding to an element of the first decoded stress profile a number proportional to the second adjusted drive current.

15. A display, comprising:

a display panel;

a memory; and a processing circuit comprising a first decoder and an encoder, the processing circuit being configured to:

retrieve from a memory a first encoded stress profile and a first set of symbol statistics;

process, by the first decoder, the first encoded stress profile, using the first set of symbol statistics, to form:

a first decoded stress profile, and a second set of symbol statistics;

augment the first decoded stress profile to form a second stress profile;

process, by the encoder, the second stress profile, using the second set of symbol statistics to form a second encoded stress profile; and save, in the memory, the second encoded stress profile.

16. The display of claim 15, wherein the processing, by the encoder, of the second stress profile with the second set of symbol statistics to form the second encoded stress profile comprises encoding the second stress profile utilizing entropy encoding.

17. The display of claim 16, wherein the processing, by the encoder, of the second stress profile with the second set of symbol statistics to form the second encoded stress profile comprises encoding the second stress profile utilizing arithmetic encoding.

18. The display of claim 15, wherein the processing circuit further comprises a second decoder and the processing circuit is further configured to:

process, by the second decoder, the first encoded stress profile with the first set of symbol statistics, to form the first decoded stress profile;

calculate a first adjusted drive current, based on a first raw drive current and on the first decoded stress profile; and drive a sub-pixel of the display with a current equal to the first adjusted drive current.

19. The display of claim 18, wherein the processing circuit is further configured to:

after driving the sub-pixel of the display with the current equal to the first adjusted drive current:

calculate a second adjusted drive current, based on a second raw drive current and on the first decoded stress profile; and drive the sub-pixel of the display with a current equal to the second adjusted drive current.

20. The display of claim 19, wherein the augmenting of the first decoded stress profile to form the second stress profile comprises adding to an element of the first decoded stress profile a number proportional to the second adjusted drive current.

* * * * *